US007805789B1

(12) United States Patent
Dean

(10) Patent No.: US 7,805,789 B1
(45) Date of Patent: Oct. 5, 2010

(54) ASSIST HANDLE FOR A BED

(76) Inventor: Mark Ronald Dean, 910 Rowntree Dairy Road, #15, Woodbridge, ON (CA) L4M 5W9

( * ) Notice: Subject to any disclaimer, the term of this patent is extended or adjusted under 35 U.S.C. 154(b) by 0 days.

(21) Appl. No.: 12/380,422

(22) Filed: Feb. 27, 2009

(51) Int. Cl.
*A47C 21/00* (2006.01)

(52) U.S. Cl. ..... 5/662; 5/646

(58) Field of Classification Search ..... 5/621, 5/646, 430, 662
See application file for complete search history.

(56) References Cited

U.S. PATENT DOCUMENTS

| | | | | |
|---|---|---|---|---|
| 5,335,385 | A | 8/1994 | Brown | |
| 5,337,430 | A * | 8/1994 | Schlein | 5/662 |
| 6,012,182 | A | 1/2000 | Allen et al. | |
| 6,039,293 | A | 3/2000 | Minet | |
| 6,058,531 | A * | 5/2000 | Carroll | 5/430 |
| 6,240,583 | B1 * | 6/2001 | Brooke et al. | 5/662 |
| D445,614 | S | 7/2001 | Sommerfeld et al. | |
| 6,560,794 | B2 | 5/2003 | Allen et al. | |
| D475,559 | S | 6/2003 | Roussy | |
| 6,728,985 | B2 | 5/2004 | Brooke et al. | |
| 6,813,789 | B2 | 11/2004 | Leoutsakos | |
| D520,783 | S | 5/2006 | Freeborn et al. | |
| 7,039,971 | B2 | 5/2006 | Sebastien | |
| 7,150,058 | B2 | 12/2006 | Rabska et al. | |
| 2006/0230540 | A1 * | 10/2006 | Whelan | 5/662 |

* cited by examiner

*Primary Examiner*—Michael Trettel
(74) *Attorney, Agent, or Firm*—Montgomery Patent and Design; Robert C. Montgomery; Joseph T. Yaksich

(57) ABSTRACT

An apparatus to assist users in getting in and out of bed is herein disclosed, comprising a handle assembly approximately three (3) feet long and positioned in a horizontal configuration along the frame of the bed. During use, it pivots upward to a vertical configuration at the midpoint of the side of the bed by use of a spring-loaded pivot point. A small release button at the top of the handle allows it to move from its horizontal position to its vertical position and back again. Thus it can aid someone in getting in or out of bed, yet fold away so as to not be noticeable under a bed spread or comforter when not in use. The apparatus is viewed as being ideal for those who may be suffering from back pain or who are unable to lie down or get up without assistance.

14 Claims, 3 Drawing Sheets

ASSIST HANDLE FOR A BED

RELATED APPLICATIONS

The present invention was first described in a notarized Official Record of Invention on Jan. 16, 2008, that is on file at the offices of Montgomery Patent and Design, LLC, the entire disclosures of which are incorporated herein by reference.

FIELD OF THE INVENTION

The present invention relates generally to an apparatus to assist users in entering and exiting a bed.

BACKGROUND OF THE INVENTION

Individuals with physical disabilities or with limited endurance, such as the elderly, know all too well of some of the difficulties that they encounter in daily life. One (1) of these tasks is the simple act of entering and exiting a bed. Disabled users have other aids throughout their homes such as railings on stairways; grab bars in bathrooms, and even mechanical assisted chairs, but nothing to help them when entering and exiting a bed. Such activity is further complicated by the low nature of many beds and the fact that bones and muscle groups are stiff when getting up in the morning. Similar problems are faced by those who suffer from back pain as well. Accordingly, there exists a need for a means by which easy and ready assistance can be provided to enter and exit a bed. The development of the apparatus described herein fulfills this need.

There have been attempts in the past to invent assist mechanisms to help individuals enter and exit a bed. U.S. Pat. No. D 520,783 issued to Freeborn discloses a wheeled rotating assist rail for beds. Unfortunately, this design patent does not appear to be similar in appearance to the disclosed apparatus, nor does it appear to comprise a multi-position handle that can be attached to a bed.

U.S. Pat. No. 7,150,058 issued to Rabska discloses an assist handle assembly for beds that appears to comprise an assist handle and one (1) or more latch configurations for latching the assist handle in one (1) or more fixed positions relative to the bed. Unfortunately, this patent does not appear to disclose an assist handle for beds that comprises a handle that is capable of being mounted flush with the bed surface and raised to various vertical positions when needed.

U.S. Pat. No. 7,039,971 issued to Sebastien discloses a handle for hospital bed comprising a handle coupled to a frame of a patient support by a bracket and a locking mechanism. Unfortunately, this patent does not appear to disclose a handle that comprises a latching assembly comprising springs and apertures, nor does sit appear that this patent discloses a handle with a release button conveniently mounted on top of the handle.

U.S. Pat. No. 6,813,789 issued to Leoutsakos discloses a bed transfer assist method and apparatus comprising a fixed handle portion that is attached to a section that is positioned under the mattress of a bed. Unfortunately, this patent does not appear to disclose an assist handle for beds that is attached to the bed frame via a mounting bracket, nor does it appear to disclose a handle that may be positioned flush to the bed frame when not needed by a user.

U.S. Pat. No. 6,728,985 issued to Brooke et al. discloses an ambulatory assist arm apparatus for use with a patient support having a support surface and a frame that includes a mounting bracket and a body that is attached to a bed frame. Unfortunately, this patent does not appear to disclose an assist handle for beds that comprises a handle that is capable of being mounted flush with the bed surface and raised to various vertical positions when needed, nor does it appear to disclose a top mounted push button to release the assist handle.

U.S. Pat. No. D 475,559 issued to Roussy discloses an assist rail that is mountable to a bed. Unfortunately, this design patent does not appear to be similar in appearance to the disclosed apparatus, nor does this patent appear to disclose an elongated handle that is capable of being moved into a flush position with the bed frame.

U.S. Pat. No. D 445,614 issued to Sommerfield discloses a pivotable support for an articulated bed. Unfortunately, this patent does not appear to disclose an assist handle for beds, nor does it appear to disclose a device that is similar in appearance to the disclosed apparatus.

U.S. Pat. No. 6,560,794 issued to Allen et al. discloses a handrail in the form of a convoluted section attached to a vertical pole and stabilized by a bed frame attachment member and a floor contacting base frame. Unfortunately, this patent does not appear to disclose an assist handle for beds that comprises a handle that is capable of being mounted flush with the bed surface and raised to various vertical positions when needed.

U.S. Pat. No. 6,039,293 issued to Minet discloses an auxiliary device for patients comprising a holder, a securing assembly for the holder onto a side of the bed and a post adjustably received in the holder with an upper end of the post provided with handles or grips. Unfortunately, this patent does not appear to comprise a bed-assist handle that comprises an elongated handle with a push button release located on the top of the handle.

U.S. Pat. No. 6,012,182 issued to Allen discloses a bed or chair assist apparatus comprising a plurality of spaced, parallel hand grips in a rounded frame attached to a vertical pole stabilized by a bed frame. Unfortunately, this patent does not appear to disclose an assist handle for beds that comprises a handle that is capable of being mounted flush with the bed surface and raised to various vertical positions when needed.

U.S. Pat. No. 5,335,385 issued to Brown describes a semicircular support mechanism that is mountable to a bed frame. Unfortunately, this patent does not appear to describe an assist handle for beds that comprises a handle that is capable of being mounted flush with the bed surface and raised to various vertical positions when needed.

SUMMARY OF THE INVENTION

In light of the disadvantages as described in the prior art, it is apparent that there is a need for an assist handle for beds which provides a simple yet effective means of assisting a person entering and exiting a bed.

An object of the assist handle for beds comprises a manufacture of a durable, rigid material such as metal or thermoplastic.

Another object of the assist handle for beds comprises a length of approximately three (3) feet that rotates and locks in various positions.

Another aspect of the assist handle for beds comprises an outer housing assembly, further comprising an outer tube which is of diameter sufficient to receive an inner tube when inserted. The outer housing assembly is attached to an inner housing assembly via an end fastener.

A further aspect of the assist handle for beds comprises an inner housing assembly that is attached to the mounting plate by an assembly fastener. The inner housing assembly comprises an inner tube which outwardly extends from the center of said inner housing assembly. A generally circular positioning dial is located about the base of the inner tube and provides a means of positioning and locking the outer housing via at least three (3) position notches.

Still another aspect of the assist handle for beds comprises a lever that is provided to engage within the notches at a desired position. The lever is hingedly attached to the outer housing assembly and further comprises a grip portion which provides a secure, comfortable gripping surface thereto a user.

Still a further aspect of the assist handle for beds comprises a rod within the handle and provides an actuating linkage to the lever via a raising and lowering motion. The rod further comprises a first spring and a release button. The assist handle further comprises a second spring which provides a means to assist a weak or physically challenged user with changing the position of the handle.

Yet another aspect of the assist handle for beds comprises a mounting plate that provides a means of attaching the apparatus to a bed frame via a plurality of mounting fasteners. The mounting fastener apertures are required in the bed frame in a position suitable for attaching the apparatus via the mounting fasteners.

A method of installing and utilizing the apparatus may be achieved by performing the following steps: preparing the bed frame by drilling appropriately located mounting fastener apertures therein; retrieving the apparatus; attaching the apparatus to the bed frame via the mounting fasteners; placing the apparatus in a lowered position until utilized; gripping the grip portion of the handle; engaging the release button, thus manually actuating the lever via the lever actuator and unlocking the outer housing assembly; allowing the handle and outer housing assembly to rise due to the force which is applied from the second spring; disengaging the release button; positioning the handle therein the intermediate position if desired; engaging the release button, thus manually actuating the lever and unlocking the outer housing assembly; positioning the handle in a raised configuration; using the handle as an assist to enter and exit the bed; engaging the release button and rotating the handle thus placing the apparatus in a lowered position during times of non-use; and, benefiting from the convenience, safety, and physical ease afforded a user of the present apparatus.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
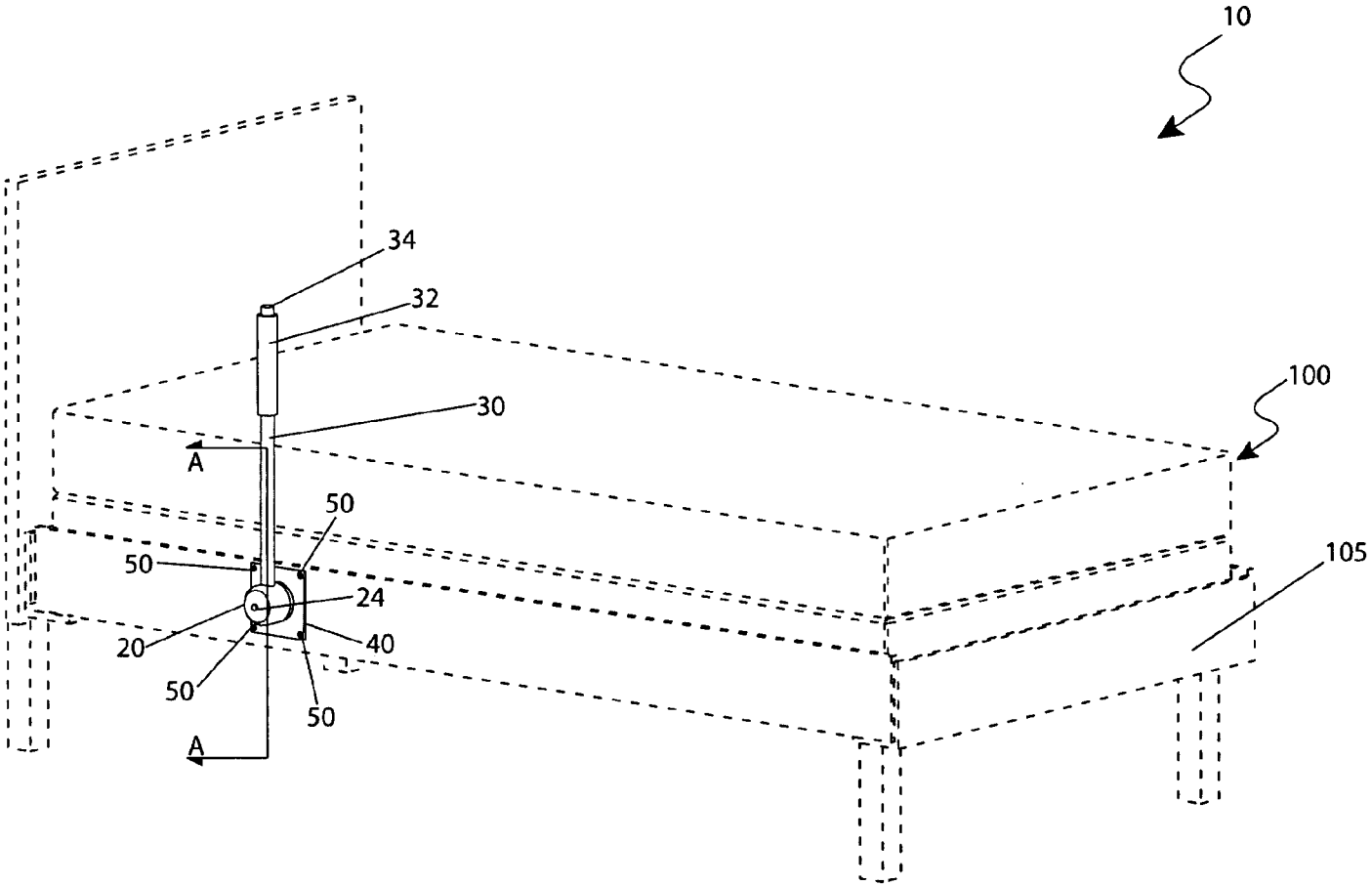
FIG. 1 is an environmental view of an assist handle for beds 10 depicted in a raised position, according to a preferred embodiment of the present invention.

10 assist handle for beds
20 outer housing assembly.
22 outer tube
24 housing fastener
26 lever
28 hinge
30 handle
32 grip portion
34 release button
36 rod
37 lever actuator
38 first spring
40 mounting plate
50 mounting fastener
52 mounting fastener aperture
54 assembly fastener
56 assembly fastener aperture
60 inner housing assembly
62 positioning dial
63 first notch
64 second notch
65 third notch
66 inner tube
67 second spring
100 bed
105 bed frame

DETAILED DESCRIPTION OF THE PREFERRED EMBODIMENT

Figure 2:
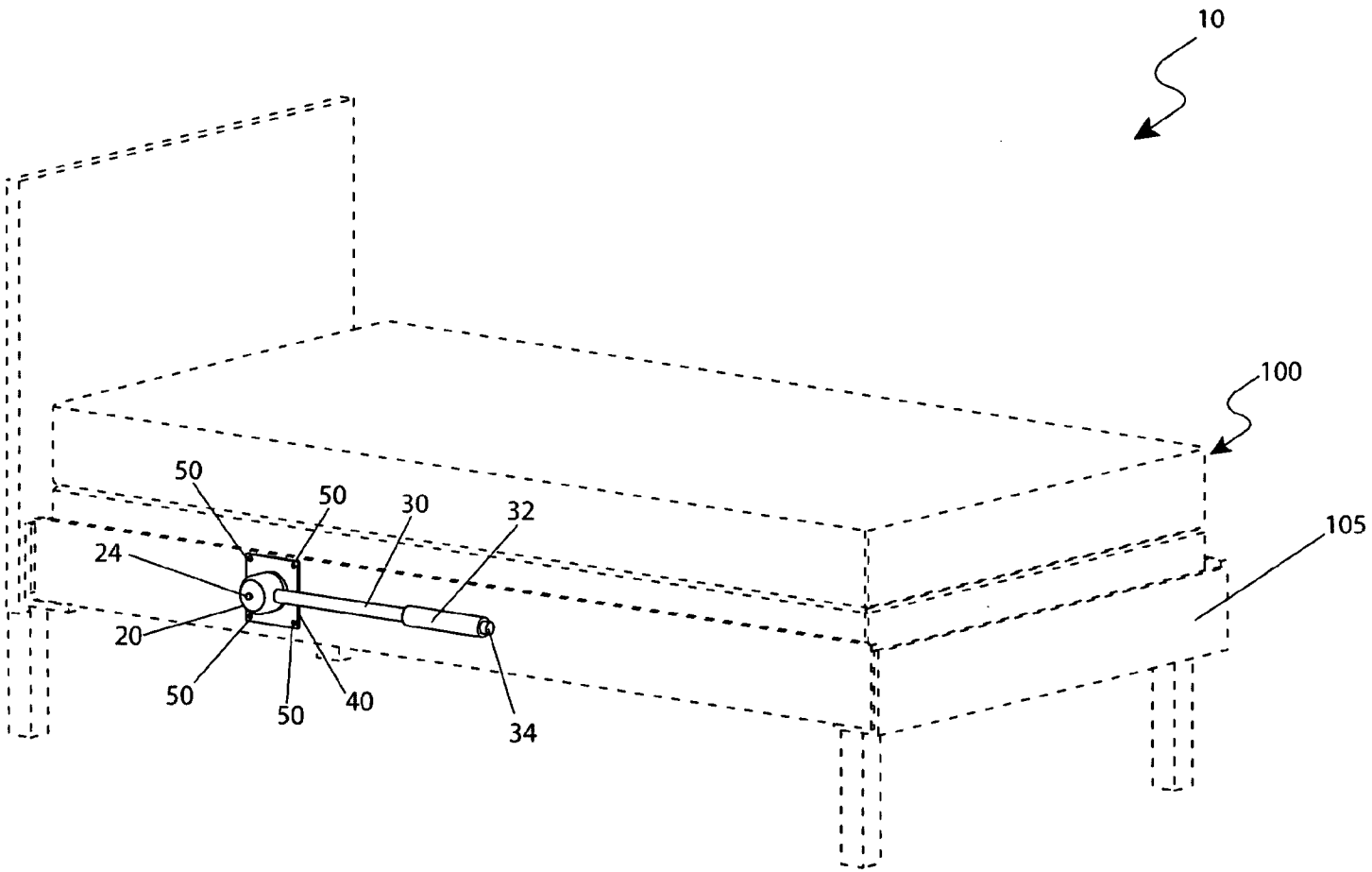
FIG. 2 is an environmental view of an assist handle for beds 10 depicted in a lowered position, according to a preferred embodiment of the present invention; and, FIG. 3 is a section view taken along line A-A of an assist handle for beds 10, according to a preferred embodiment of the present invention.
Figure 3:
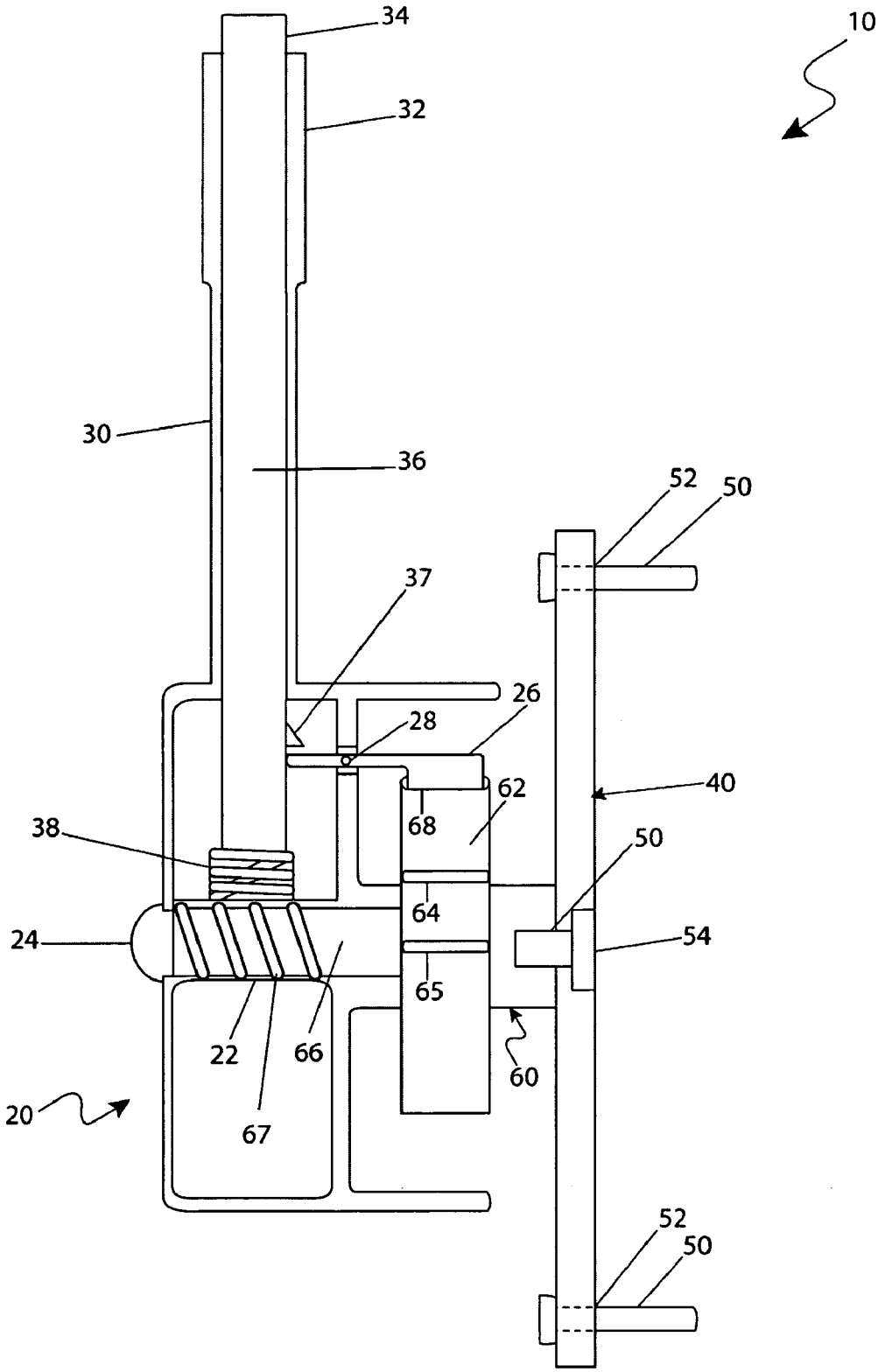

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an assist handle for beds (herein described as the "apparatus") 10, which provides a simple yet effective means of assisting a person the getting in to and out of a bed 100. The apparatus 10 generally comprises an outer housing 20, a handle 30, and a mounting plate 40 which is attached thereto a bed frame 105.

Referring now to FIGS. 1 and 2, environmental views of the apparatus 10, according to the preferred embodiment of the present invention, is disclosed. The apparatus 10 is preferably made of a durable, rigid material such as metal, thermoplastic, or the like. The handle 30 is approximately three (3) feet long and rotates and locks in various positions. The apparatus 10 is envisioned to reside in at least three (3) positions: a lowered, generally horizontal position (see FIG. 2); a raised, generally vertical position (see FIG. 1); and an intermediate configuration (not shown). Although illustrated comprising three (3) positions, it is understood that the apparatus 10 may be introduced comprising incremental position changes throughout a range of motion and as such should not be viewed as a limiting factor of said present apparatus 10. The mounting plate 40 provides a means of attaching the apparatus 10 thereto a bed frame 105 via a plurality of mounting fasteners 50.

Referring now to FIG. 3, a section view taken along section line A-A of the apparatus 10, according to the preferred embodiment of the present invention, is disclosed. The apparatus 10 comprises an outer housing assembly 20 and an inner housing assembly 60. The inner housing assembly 60 is attached thereto the mounting plate 40 via an assembly fastener 54. The assembly fastener 54 is preferably a standard mechanical fastener such as a bolt or the like. An assembly fastener aperture 56 is located therethrough the center of the mounting plate 40 and therein the center of a rear surface of the inner housing assembly 60. Once the assembly fastener apertures 56 are aligned, the assembly fastener 54 is threadingly inserted therethrough, thus fastening the inner housing assembly 60 thereto the mounting plate 40. The outer housing assembly 20 rotatingly attaches thereto the inner housing assembly 60, thus enabling said outer housing assembly 20 and handle 30 to rotate thereabout said inner housing assembly 60. The inner housing assembly 60 comprises an inner tube 66 which outwardly extends therefrom the center of said inner housing assembly 60. The outer housing assembly 20 comprises an outer tube 22 which is located therewithin the center of said outer housing assembly 20 which further comprises a diameter sufficient to receive the inner tube 66 when inserted therein. The outer housing assembly 20 is attached thereto the inner housing assembly 60 via an end fastener 24 which threadingly attaches thereto the inner tube 66, thereby enabling said outer housing assembly 20 to freely rotate thereabout said inner tube 66. The apparatus 10 further comprises a means to lock the outer housing assembly 20 and handle 30 therein a preferred position, thereby providing a stable support thereto a user. A generally circular positioning dial 62 is located thereabout the base of the inner tube 66 and provides a means of positioning and locking the outer housing 20 via at least three (3) position notches. A first notch 63 is located thereabout a "twelve o'clock" position and locks the handle 30 therein the raised position. A third notch 65 is located thereabout a "three o'clock" position and locks the handle therein the lowered position. A second notch 64 is located thereabout a midway point and locks the handle therein the intermediate position. A lever 26 is provided to engage therewithin the notches 63, 64, 65 at a desired position. The lever 26 is hingedly attached thereto the outer housing assembly 20. The handle 30 is rigidly attached thereto the outer housing assembly 20 and further comprises a grip portion 32 thereon a distal end which provides a secure, comfortable gripping surface thereto a user. A rod 36 is located therewithin the handle 30 and provides an actuating linkage thereto the lever 26 via an up and a down motion. A first spring 38 is located thereon a lower end of the rod 36 which applies a constant compressive upward force thereupon said rod 36. When a user engages a release button 34 located thereon an upper end of the rod 36 by applying a downward force thereon, the rod 36 moves in a downward direction, thereby engaging the lever 26 via a lever actuator 37. The lever actuator 37 applies a downward force thereupon a free end of the lever 26 thereby lifting the engaging end of said lever 26, which is in contact therewith the desired notch 63, 64, 65 via the hinge 28. Once the lever 26 is free therefrom the desired notch 63, 64, 65 the outer housing assembly 20 and the handle 30 are free to rotate therearound the inner housing assembly 60. The hinge 20 is preferably a spring-loaded hinge which naturally tends to force the engaging end of the lever 26 to be in contact therewith the positioning dial 62 when the release button 34 is not engaged. As the handle 30 and outer housing assembly 20 are rotated, the lever 26 will naturally engage therewithin the next approaching notch 63, 64, 65 as said lever 26 traverses the positioning dial 62. The apparatus 10 further comprises a second spring 67 which is permanently attached therebetween the inner tube 66 and the outer tube 22. The second spring 67 provides a compressive force thereupon the outer housing assembly 20 when the apparatus 10 is in the lowered position, thus when in said lowered position and the release button 34 is engaged the handle 30 will naturally begin the approach the raised position. The second spring 67 provides a means to assist a weak or physically challenged user with changing the position of the handle 30. To maintain the safety of the user, the handle 30 is unable to automatically rise higher than the intermediate position due to the lever 26 naturally engaging the second notch 64. Although illustrated comprising a positioning dial 62 further comprising a plurality of notches 63, 64, 65, a manually actuated lever 26 to provide the locking means thereto the handle 20 and outer housing 20, and a release button 34 to manually actuate the lever 26; it is understood that various other locking and releasing means are contemplated, such as spring-loaded pins, interconnecting gears, or the like and as such should not be viewed as a limiting factor of the present apparatus 10. The mounting plate 40 is preferably a durable rigid material comprising a plurality of mounting fastener apertures 52 therethrough. Corresponding mounting fastener apertures 52 are required therein the bed frame 105 in a position suitable for attaching the apparatus 10 via the mounting fasteners 50. The apparatus 10 is illustrated comprising a mounting plate 40 and mounting fasteners 50 which are standard hardware fasteners and attached thereto a wooden bed frame 105 which would simply require mounting fastener apertures 52 to be drilled therein in order to attach said apparatus 10 thereto said bed frame 105. It is further contemplated that the mounting plate 50 may attach thereto a metal bed frame 105 in a similar manner comprising alternate mounting fasteners 50, such as clamps or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 and 2.

The method of installing and utilizing the apparatus 10 may be achieved by performing the following steps: preparing the bed frame 105 by drilling appropriately located mounting fastener apertures 52 therein; retrieving the apparatus 10; attaching the apparatus 10 thereto the bed frame 105 via the mounting fasteners 50; placing the apparatus 10 therein a lowered position until utilized; gripping the grip portion 32 of the handle 30; engaging the release button 34, thus manually actuating the lever 26 via the lever actuator 37 and unlocking the outer housing assembly 20; allowing the handle 30 and outer housing assembly 20 to rise due to the force which is applied therefrom the second spring 67; disengaging the release button 34; positioning the handle 30 therein the intermediate position if desired; engaging the release button 34, thus manually actuating the lever 26 and unlocking the outer housing assembly 20; positioning the handle 30 therein a raised configuration; using the handle 30 as an assist to enter and exit the bed 100; engaging the release button 34 and rotating the handle 30 thus placing the apparatus 10 in the lowered position during times of non-use; and, benefiting from the convenience, safety, and physical ease afforded a user of the present apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A support mechanism, comprising:

a mounting plate attached thereto a frame of a bed;

an inner housing assembly attached thereto said mounting plate;

an outer housing assembly rotatingly attached thereto said inner housing assembly; and, an elongated handle connected thereto said outer housing assembly;

wherein said elongated handle and said outer housing assembly rotate with respect to said inner housing assembly; and, wherein said elongated handle provides a support means for assisting a user in entering and exiting said bed.

2. The support mechanism of claim 1, wherein said support mechanism further comprises a locking means for locking said elongated handle and said outer housing assembly into a desired position.

3. The support mechanism of claim 1, wherein said inner housing assembly further comprises an inner tube extending outward therefrom said mounting plate along a central axis of said inner housing assembly.

4. The support mechanism of claim 3, wherein said outer housing assembly further comprises an outer tube for receiving said inner tube therein, thereby allowing said outer housing assembly to rotate with respect to said inner housing assembly.

5. The support mechanism of claim 1, wherein said support mechanism further comprises a positioning dial located thereat said inner housing assembly.

6. The support mechanism of claim 5, wherein said positioning dial provides a means of positioning said elongated handle and said outer housing assembly at a variety of desired positions.

7. The support mechanism of claim 2, wherein said support mechanism further comprises a release button thereon said handle for releasing said locking means, thereby allowing a user to adjust a location of said desired position.

8. The support mechanism of claim 2, wherein said support mechanism further comprises an assist means to help said user change a position of said elongated handle and said outer housing assembly.

9. The support mechanism of claim 8, wherein said assist means comprises a spring.

10. The support mechanism of claim 1, wherein said mounting plate is attached thereto said frame of said bed by a fastener.

11. The support mechanism of claim 1, wherein said elongated handle is approximately three (3) feet long.

12. The support mechanism of claim 1, wherein said elongated handle further comprises a grip portion.

13. A method for using a support mechanism, said method comprising the steps of:

providing said support mechanism, comprising:

a mounting plate attached thereto a frame of a bed;

an inner housing assembly attached thereto said mounting plate;

an outer housing assembly rotatingly attached thereto said inner housing assembly; and, an elongated handle connected thereto said outer housing assembly;

wherein said elongated handle and said outer housing assembly rotate with respect to said inner housing assembly; and, wherein said elongated handle provides a support means for assisting a user in entering and exiting said bed;

placing said elongated handle therein a lowered position until utilized;

gripping a grip portion of said handle;

engaging a release button;

allowing said handle and said outer housing assembly to rise due to a force which is applied therefrom a spring;

disengaging said release button;

positioning said elongated handle therein a desired position;

engaging said release button;

positioning said elongated handle therein a raised position;

using said elongated handle as an assist to enter and exit said bed; and, engaging said release button and rotating said elongated handle, thus placing said elongated handle in said lowered position during times of non-use.

14. The method of claim 13, further comprising the additional steps of:

preparing a bed frame by drilling appropriately located mounting fastener apertures therein;

retrieving said support mechanism; and, attaching said support mechanism thereto said bed frame via at least one (1) mounting fastener.

* * * * *